US006608436B1

(12) United States Patent
Sluyterman et al.

(10) Patent No.: US 6,608,436 B1
(45) Date of Patent: Aug. 19, 2003

(54) COLOR DISPLAY DEVICE HAVING QUADRUPOLE CONVERGENCE COILS

(75) Inventors: Albertus Aemilius Seyno Sluyterman, Eindhoven (NL); Nicolaas Gerrit Vink, Eindhoven (NL); Tjerk Gerrit Spanjer, Eindhoven (NL); Leopold Cyrille Maria Beirens, Eindhoven (NL); Antonius Henricus Van Tiel, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 21 days.

(21) Appl. No.: 09/763,303

(22) PCT Filed: Jun. 21, 2000

(86) PCT No.: PCT/EP00/05710

§ 371 (c)(1),
(2), (4) Date: Feb. 20, 2001

(87) PCT Pub. No.: WO00/79562

PCT Pub. Date: Dec. 28, 2000

Related U.S. Application Data

(63) Continuation-in-part of application No. 09/338,049, filed on Jun. 22, 1999, now Pat. No. 6,411,027, which is a continuation-in-part of application No. 09/218,550, filed on Dec. 22, 1998.

(30) Foreign Application Priority Data

Apr. 27, 2000 (EP) ..... 00201507

(51) Int. Cl.[7] ..... H01J 29/70

(52) U.S. Cl. ..... 313/440; 313/412; 313/426; 335/210; 335/213

(58) Field of Search ..... 313/412, 413, 313/421, 426, 428, 440; 315/364, 368.15, 368.26, 368.27, 368.28; 335/210, 213

(56) References Cited

U.S. PATENT DOCUMENTS

RE35,548 E * 7/1997 Sluyterman et al. ... 315/368.28
6,031,345 A * 2/2000 Nakata ..... 313/440 X
6,376,981 B1 * 4/2002 Sluyterman et al. ..... 313/440

* cited by examiner

*Primary Examiner*—Hoan Tran

(57) ABSTRACT

A color display device having an in-line electron gun (5) for generating three electron beams (6,7,8), and a convergence unit (14') to dynamically influence the convergence of the electron beams, preferably to decrease a distance (p) between the electron beams. The convergence unit (14') includes a ring-shaped element (21') having coils (22') formed by electrically conductive wires, which have been toroidally wound in a winding direction and according to a winding density distribution N ($\phi$) given by N ($\phi$)=$N_0$ cos (2$\phi$)+C where $\phi$ is an angle enclosed by the X-direction and a line between an element of the coil and the center, which ranges between 0° and 360°, $N_0$ is a given winding density, the sign of N ($\phi$) denotes the winding direction, and C is a constant different from zero, and preferably equal to $-N_0$.

11 Claims, 4 Drawing Sheets

COLOR DISPLAY DEVICE HAVING QUADRUPOLE CONVERGENCE COILS

CROSS-REFERENCE TO RELATED APPLICATION

This application is a Continuation-in-part of U.S. patent application Ser. No. 09/338,049 filed Jun. 22, 1999 (now U.S. Pat. No. 6,411,027) which is a Continuation-in-part of U.S. patent application Ser. No. 09/218,550 filed Dec. 22, 1998, both of which are hereby incorporated by reference.

BACKGROUND OF THE INVENTION

The invention relates to a color display device comprising an in-line electron gun for generating three electron beams, and a unit for deflecting the electron beams across the color selection electrode.

Such display devices are known.

A present aim is to make the outer surface of the display window flatter, so that the image represented by the color display device is perceived by the viewer as flat. However, an increase of the radius of curvature of the outer surface will lead to an increase of a number of problems. The radius of curvature of the inner surface of the display window and of the color selection electrode should increase, and, as the color selection electrode becomes flatter, the strength of the color selection electrode decreases and hence the sensitivity to doming and vibrations increases. An alternative solution to this problem would be to curve the inner surface of the display window more strongly than the outer surface. By virtue thereof, a color selection electrode having a relatively small radius of curvature can be used. As a result, doming and vibration problems are reduced, however other problems occur instead. The thickness of the display window is much larger at the edges than in the center. As a result, the weight of the display window increases and the intensity of the image decreases substantially towards the edges.

EP 0,421,523 discloses a color cathode ray tube with an in-line gun, a pin cushion correcting yoke and an eyebrow effect electronoptical distortion correction device comprising two pairs of coils, each pair having a coil on each outer electron beam side of the neck in the plane of the beams. The coil pairs are spaced apart along the Z-axis between the gun and the yoke and are driven by a sawtooth current having a bow-tie envelope synchronous with the raster scan to correct the dynamic, antisymmetrical eyebrow effect apparent as a purity defect on the raster.

WO 99/34392 describes a color display device comprising a color cathode ray tube including an in-line electron gun for generating three electron beams being located substantially within a plane extending in an X-direction of a rectangular X–Z coordinate system, a color selection electrode, deflecting means for deflecting the electron beams located at a deflection plane, and first and second influencing means to dynamically influence the convergence of the electron beams, to decrease a distance between the electron beams at a location of the deflection plane. WO 99/34392 describes many different ways in which the influencing means may be embodied. One of the possibilities mentioned is to integrate the second influencing means with the deflection unit. The second influencing means may be embodied as four coils, which generate a magnetic quadrupole field.

BRIEF SUMMARY OF THE INVENTION

It is an object of the invention to provide an improved color display device.

To this end, the invention provides a color display device, a deflection unit and a method of manufacturing such a color display device in which convergence of three electron beams from an in-line electron gun is dynamically influenced by a toroidal winding for producing a magnetic quadrupole field. Such a toroidal winding has a winding density distribution $N(\phi)$ which varies as the cosine of twice the angle $\phi$ enclosed by the X-direction and a line between an element of the coil and the center, where the X-direction is substantially transverse to the three electron beams and lies in a plane in which the three electron beams are located substantially. According to the invention the winding density has a finite non-zero value at the positions where $\cos(2\phi)=0$. Preferably the winding density at $\phi=0$ is zero.

BRIEF DESCRIPTION OF THE SEVERAL VIEWS OF THE DRAWING

In the drawings.

The figures are not drawn to scale. In the figures, like reference numerals generally refer to like parts.

DETAILED DESCRIPTION OF THE INVENTION

Figure 1:
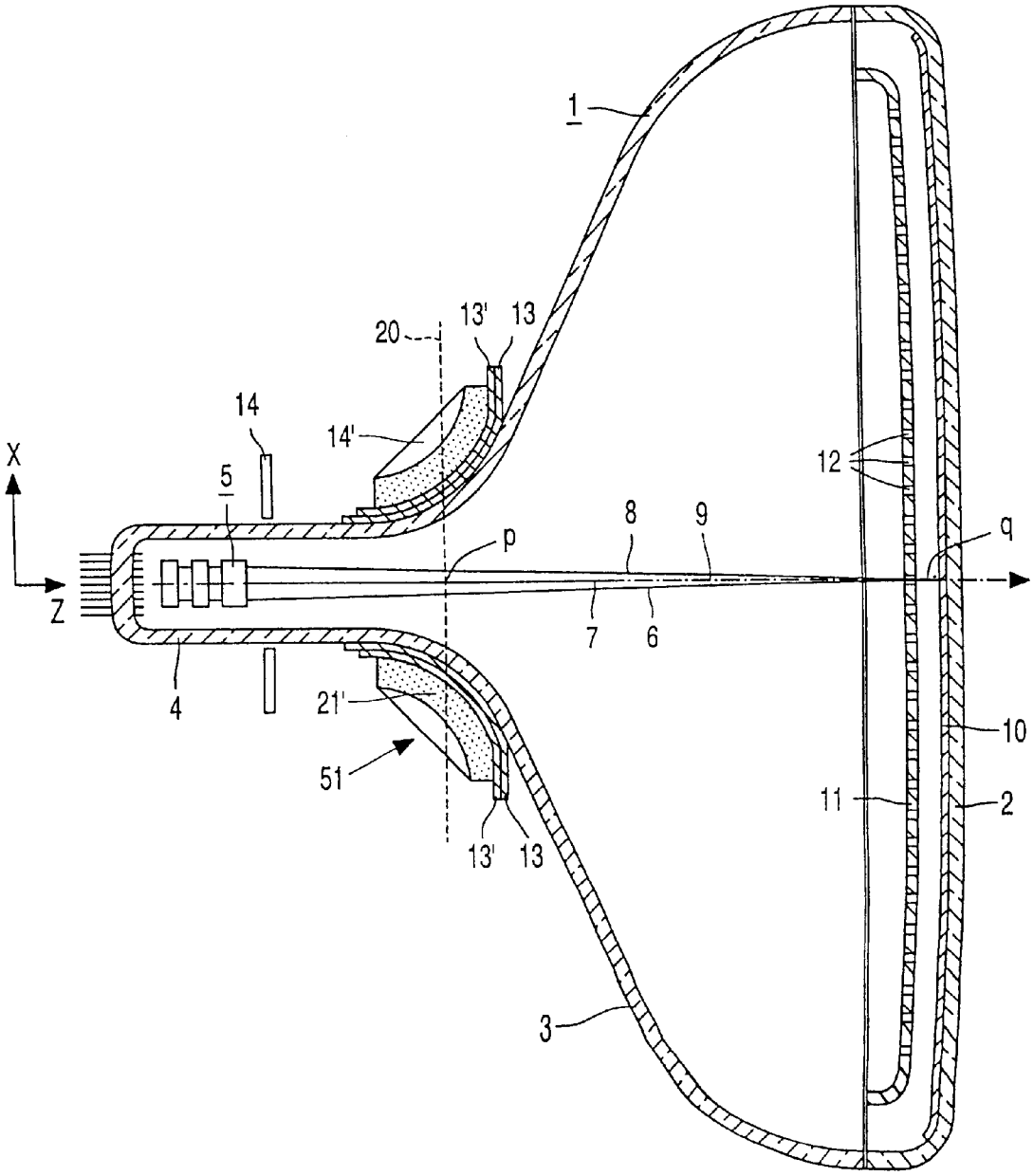
FIG. 1 is a sectional view of a display device, in which the invention is schematically shown.

The display device shown in FIG. 1 comprises a cathode ray tube, in this example a color display tube, having an evacuated envelope 1 which includes a display window 2, a cone portion 3 and a neck 4. In the neck 4 there is arranged an in-line electron gun 5 for generating three electron beams 6, 7 and 8 which extend in one plane, the in-line plane, extending in an X-direction of a rectangular coordinate system. In the undeflected state, the central electron beam 7 substantially coincides with the tube axis 9, which extends in the Z-direction. A third direction, the Y-direction, extends in a direction perpendicularly to the in-line plane (not shown in the Figure). Conventionally, during operating conditions, the tube is positioned such that the X–Z plane coincides with a horizontal plane and the Y-direction coincides with a vertical direction.

The inner surface of the display window is provided with a display screen 10. The display screen 10 comprises a large number of phosphor elements luminescing in red, green and blue. On their way to the display screen, the electron beams are deflected across the display screen by way of an electromagnetic deflection unit 51 and pass through a color selection electrode 11 which is arranged in front of the display window 2 and which comprises a thin plate having apertures 12. The three electron beams 6, 7 and 8 pass through the apertures 12 of the color selection electrode at a small angle relative to each other and hence each electron beam impinges only on phosphor elements of one color. The deflection unit 51 comprises, in addition to a coil holder 13, deflection coils 13' for deflecting the electron beams in two mutually perpendicular directions. Around the deflection coils 13' a ring-shaped element, the so-called yoke-ring, is positioned. The purpose of the yoke-ring, conventionally comprising ferrite is to 'short circuit' magnetic lines of flux outside the coils. Without a yoke-ring excessively high currents through the deflection coils would otherwise have to be used and also disturbing (magnetic) stray fields would occur. The display device further includes means for generating voltages, which during operation are fed to components of the electron gun via feedthroughs. The deflection plane 20 is schematically indicated as well as the distance p between the electron beams 6 and 8 in this plane, and the distance q between the color selection electrode and the display screen. The distance q is inversely proportional to the distance p.

The color display device comprises two electron beam convergence influencing units 14, 14', whereby a first unit 14 is used, in operation, to dynamically bend, i.e. as a function of the deflection in a direction, the outermost electron beams towards each other, and a second unit 14' serves to dynamically bend the outermost electron beams in opposite directions.

The two units 14, 14' are positioned at some distance from each other, and are used to vary the distance p, as a function of the deflection, in a such a manner that the distance p decreases as a function of the deflection in at least one direction. The first unit 14 is positioned close to the gun and will be referred to as the "gun quadrupole", whereas the second unit 14' is located near the deflection unit and will be referred to as the "yoke quadrupole".

It is convenient to integrate the means 14' and the deflection unit 51 by winding coils 22' on the ring-shaped element 21', which coils generate a dynamic electromagnetic quadrupole field.

The means 14' ("the yoke ring quadrupole") then is obtained by making the coils 22' from electrically conductive wires, which are toroidally wound in a winding direction and according to a winding density distribution N (ϕ) given by $$N(\phi)=N_0 \cos(2\phi)+C$$

where ϕ is an angle enclosed by the X-direction and a line between an element of the coil and the center, which ranges between 0° and 360°, $N_0$ is a given winding density which, for the case in which C=0, equals the winding density at ϕ equal to 0°, the sign of N (ϕ) denotes the winding direction and C is a constant. According to the invention C is unequal to zero.

For the case in which $C=-N_0$, N(0)=0, where N (0) is the winding density at ϕ equal to 0° for that case.

In practice, due to the finite dimensions of the wire only an approximation of the above winding density can be realized.

Figure 2A:
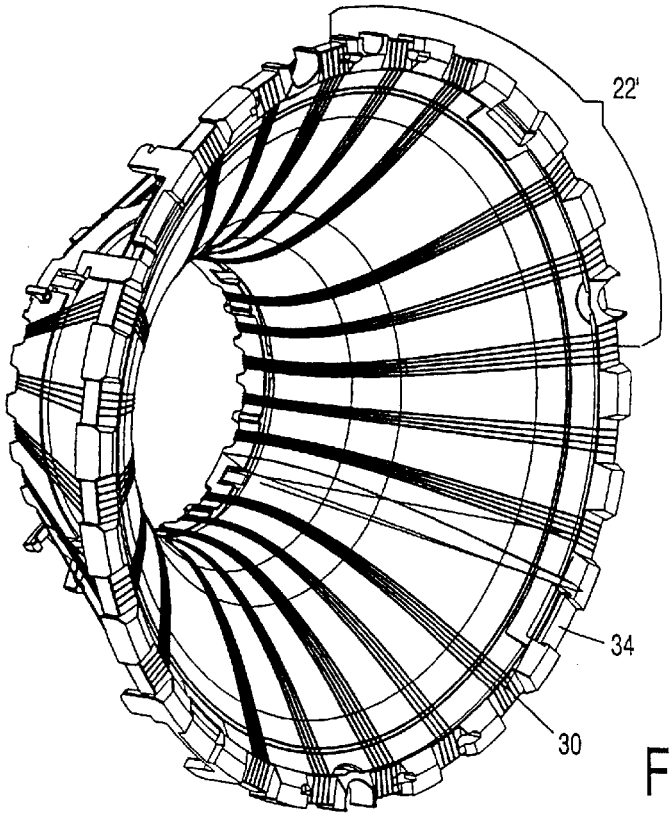
FIGS. 2A, 2B show embodiments of the second influencing means according to the invention.
Figure 2B:
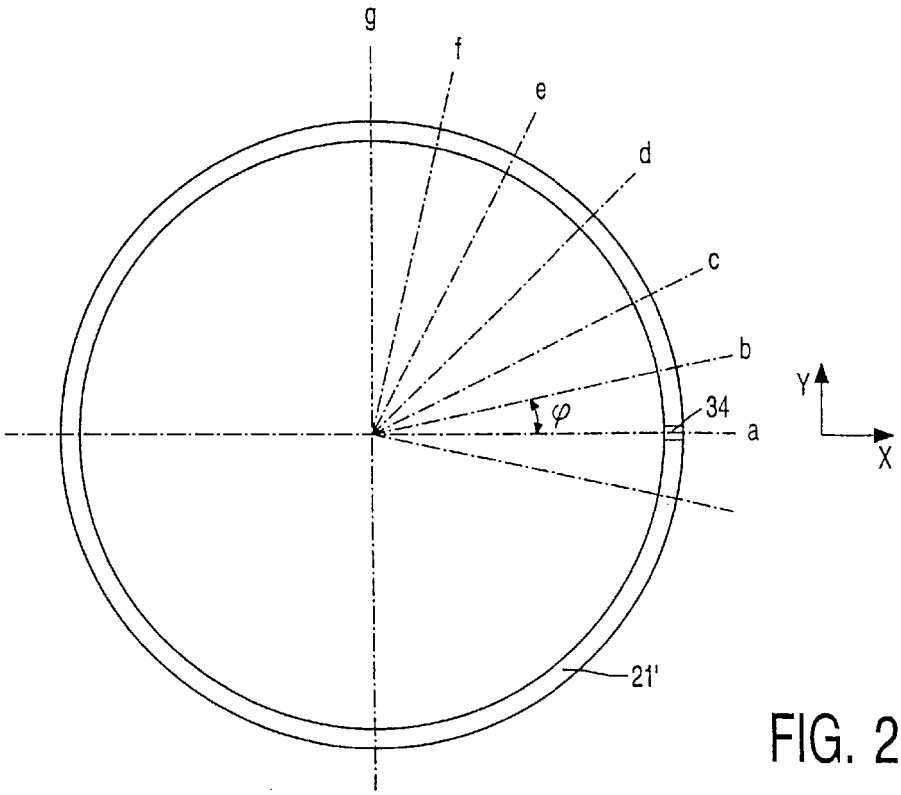

An embodiment of such an approximation is shown in FIGS. 2A and 2B, for the situation that the constant C is taken equal to zero. This embodiment comprises packages 30 of electrically conductive wires, which are toroidally wound around a yoke ring 21' according to the above winding density $N(\phi)=N_0 \cos(2\phi)$.

In this particular embodiment windings have been made in grooves 34 of yoke ring 21' that are spaced 15 degrees apart. The winding method is as follows:

18 windings in a groove at ϕ=0 degrees (position a),
15 windings in a groove at ϕ=15 degrees (position b),
9 windings at ϕ=30 degrees (position c),
no windings at ϕ=45 degrees (position d),
9 windings with current in an opposing direction in a groove at ϕ=60 degrees (position e),
15 windings at ϕ=75 degrees (position f),
18 windings at ϕ=90 degrees (position g), etc. This approximation to the ideal winding density N (ϕ) has proven in practice to give good results.

A further embodiment, for the situation that the constant C is taken to be equal to $N_0$, or $-N_0$, reference is made to FIG. 2B. This approximation to the winding density is obtained by:

0 windings in a groove at ϕ=0 degrees (position a),
3 windings in a groove at ϕ=15 degrees (position b),
9 windings at ϕ=30 degrees (position c),
18 windings at ϕ=45 degrees (position d),
27 windings with current in an opposing direction in a groove at ϕ=60 degrees (position e),
33 windings at ϕ=75 degrees (position f),
36 windings at ϕ=90 degrees (position g), etc.

This approximation to the ideal winding density N (ϕ) has the advantage that no windings occur at position a (i.e. the East position of the yoke-ring; a similar situation arises at the West position). The coil thus comprises only two packages of windings, in stead of four packages. At the East and West positions the yoke ring can be split for reasons of coil winding and/or yoke ring assembly. In this way also double saddle yokes, where the ends of the coils that are located at the gun side, have a diameter larger than the inner diameter of the yoke ring, may be used. Since for such saddle yokes it is necessary to be able to split the yoke ring during yoke assembly. Furthermore, the occurrence of significant line frequent voltages can be avoided by winding the two packages individually in layers. This is effective since the line flux changes sign at the top and bottom of the yoke-ring. Further, since the winding distribution for the upper part of the quadrupole has the same winding sign, no change of winding direction has to occur when this upper part is wound and the winding process is consequently enhanced.

Figure 3A:
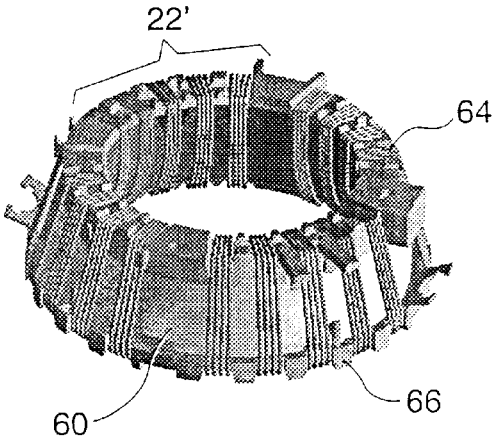
FIGS. 3A, 3B show a first and a second part of the ring-shaped element according to an embodiment of the invention.
Figure 3B:
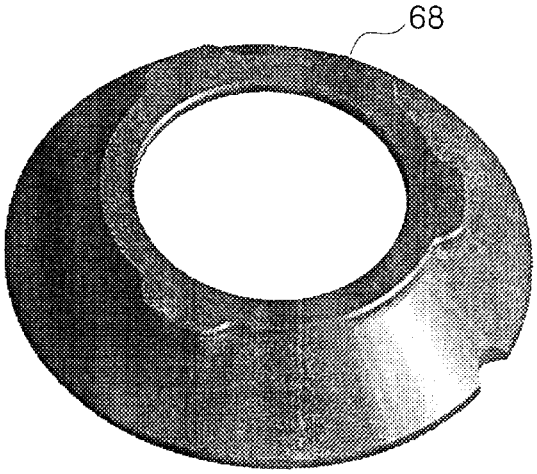

FIGS. 3A and 3B show an embodiment of the invention. FIG. 3A shows a first part 60 of the ring-shaped element 21', which part is most close to the electron gun 5. The part 60 has been provided with four coils for generating the magnetic quadrupole field. Coils are shown that have been wound in a toroidal-way according to the cos (2ϕ), C=0 winding distribution. To facilitate the winding process and to keep the individual wire elements of the coil 22' on the right position at the first part 60, the first part has been provided with rings 60,66 having grooves into which the coil windings are positioned. FIG. 3B shows a second part 68 of the ring-shaped element 21', which part is closest to the display window 2. When applied to the tube the two parts 60,68 may be connected to each other by any conventional connection means, such as glue, tape or the like. Connection of the two parts is not essential for a proper performance.

This embodiment of the invention has the advantage that it reduces the influence of the means 14' on certain image artifacts. In experiments it has been noted that during operation of the tube having the means 14' certain image artifacts, such as East-West pincushion raster distortion and an over-correction of non-linearities in the electron beam deflection, may occur. The inventors have realized that this influence may be reduced by splitting the ring-shaped element 21' into two parts 60,68. A first part 60 being positioned closer to the in-line gun 5 than a second part 68, and the first 60 and/or the second 68 part having the four coils 22'. Preferably, the quadrupole coil is wound around the core part closest to the gun. The measure provides the opportunity to shift the two core parts independently of each other, thus improving raster and convergence performance of the tube.

Figure 4:
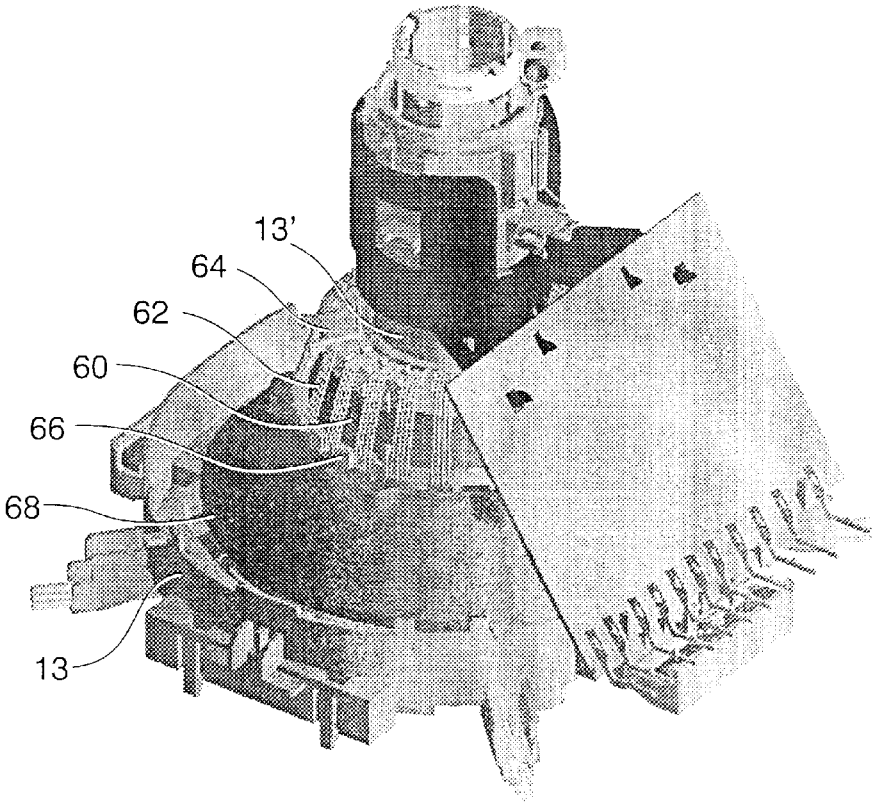
FIG. 4 shows a deflection unit according to an embodiment of the invention.

FIG. 4 shows the two parts 60,68 according to the invention when positioned around the deflection coils 13' and the coil holder 13. The first part 60 has been provided with rings 60,66 and four coils 22' for generating the magnetic quadrupole field.

Figure 5:
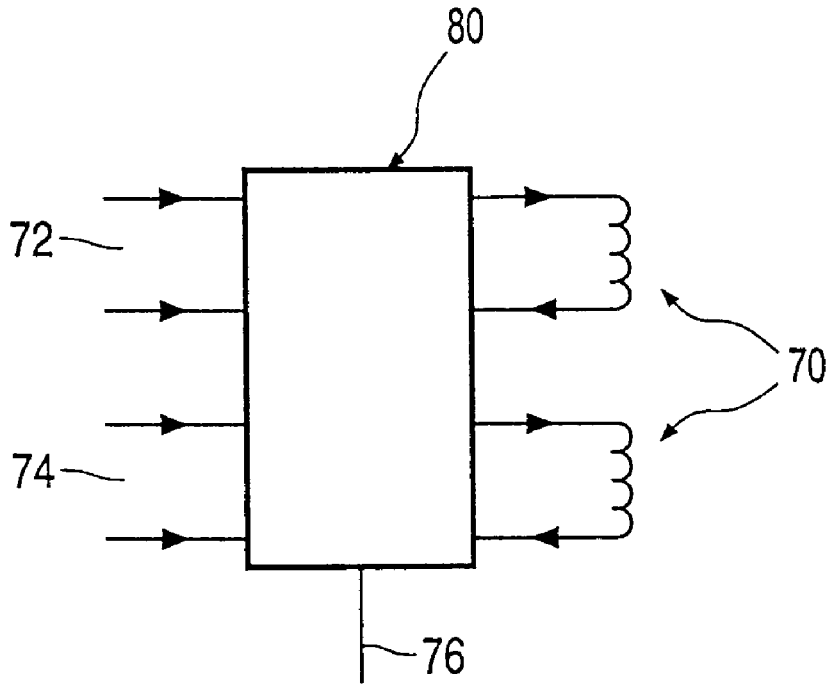
FIG. 5 shows a further embodiment of the invention.

In FIG. 5 a further embodiment of the invention is shown. The magnetic quadrupole field can simply be generated by the field coil set 70 itself, without the use of any additional coils. This is realized as follows: to the field coil set, in addition to the normal field signal for the electron deflection, an additional signal is added. This additional signal is then used for generating the quadrupole field via the field coil set. Suppose, for example, that the field coil set 70, comprising two coils, is fed with input signals 72, 74 of 2 Ampere. The signal for the quadrupole field 76 having, for example, a value of 1 Ampere, is added to the input signals 72, 74 via the asymmetrically driving means 80 to result into two asymmetrical driving signals having values of 3 and 1 Ampere, respectively. These asymmetrical signals are then fed to the two coils of the field coil set 70, which results in the magnetic field for the deflection of the electrons and the quadrupole field. The asymmetrically driving means 80 can be of the form of any conventional means within the reach of a person skilled in the art. For example, a set of two diodes properly positioned between the coils and the input signals 72, 74 may do.

A preferred method of manufacturing the second convergence unit 14' ("the yoke ring quadrupole"), where the coils 22' comprise layers, comprises the steps of: providing a ring-shaped element 21' and winding electrically conductive wire toroidally around the ring-shaped element 21'. The winding step comprises of a first step winding a first layer of each of the coils, and at least one further step, of winding a further layer of each of the coils.

This method of winding the second convergence unit is different from a simpler method in which the coils are wound in one layer. The simpler method however, may cause ringing problems as well as reliability problems. Ringing is an unwanted inductive interference phenomenon between line and frame coils 13' of the deflection unit 51. The preferred method of winding according to the invention is visible by the many interconnection wires between the four coils 22.

In summary, a preferred embodiment of the invention relates to a color display device comprising an in-line electron gun 5 for generating three electron beams 6,7,8, and a convergence unit 14' to dynamically influence the convergence of the electron beams, to decrease a distance p between the electron beams. The convergence unit 14' comprises a ring-shaped element 21' having four coils 22'. The coils 22' comprise electrically conductive wires, which are toroidally wound in a winding direction and according to a winding density distribution N ($\phi$) given by $N(\phi)=N_0 \cos(2\phi)+C$;

where $\phi$ is an angle enclosed by the X-direction and a line between an element of the coil and the center, which ranges between 0° and 360°, $N_0$ is a given winding density, the sign of N ($\phi$) denotes the winding direction, and C is a constant. According to the invention, C is unequal to zero.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of other elements or steps than those listed in a claim. The word "a" or "an" preceding an element does not exclude the presence of a plurality of such elements. The mere fact that certain measures are recited in mutually different dependent claims does not indicate that a combination of these measures cannot be used to advantage. In the device claim enumerating a plurality of means, several of these means can be embodied by the same item of hardware.

What is claimed is:

1. A color display device comprising an in-line electron gun (5) for generating three electron beams (6,7,8) located substantially within a plane extending in an X-direction of a rectangular X–Z coordinate system, deflecting means (51) for deflecting the electron beams (6,7,8), and convergence means (14') for dynamically influencing the convergence of the electron beams, the convergence means (14') comprising means for generating a magnetic field that corresponds to a magnetic quadrupole field, said convergence means comprising coils (22') that comprise electrically conductive wires which have been toroidally wound in a winding-direction and according to a winding density distribution N ($\phi$) given by $N(\phi)=N_0 \cos(2\phi)+C$;,where $\phi$ is an angle enclosed by the X-direction and a line between an element of the coil and the center of the coil, which ranges between 0° and 360°, $N_0$ is a given winding density, the sign of N ($\phi$) denotes the winding direction, and C is a constant unequal to zero.

2. A color display device according to claim 1, wherein the means for generating a magnetic quadrupole field comprise a ring-shaped element (21') having said coils (22').

3. A color display device according to claim 2, wherein said coils (22') of the convergence means (14') comprise packages (30) of electrically conductive wires, said packages (30) being toroidally wound in a winding direction and according to an approximate winding density distribution N ($\phi$) described by $N(\phi)=N_0 \cos(2\phi)+C$;

where $\phi$ is an angle enclosed by the X-direction and a line between an element of the package and said center.

4. A color display device according to claim 1, wherein the constant C equals $+N_0$.

5. A color display device according to claim 1, wherein the constant C equals $+N_0$ or $-N_0$.

6. A color display device according to claim 1, wherein the deflecting means (51) comprises a field coil set, and the means for generating a magnetic quadrupole field comprise the field coil set and means for asymmetrically driving the field coil set.

7. A color display device comprising an in-line electron gun (5) for generating three electron beams (6,7,8) located substantially within a plane extending in an X-direction of a rectangular X–Z coordinate system, deflecting means (51) for deflecting the electron beams (6,7,8), and convergence means (14') for dynamically influencing the convergence of the electron beams, the convergence means (14') comprising means for generating a magnetic field that corresponds to a magnetic quadrupole field, said means for generating comprising a ring-shaped element (21') having coils (22') that comprise electrically conductive wires which have been toroidally wound in a winding direction and according to a winding density distribution N (ϕ) given by N (ϕ)=$N_0$ cos (2ϕ)+C; where ϕ is an angle enclosed by the X-direction and a line between an element of the coil and the center of the coil, which ranges between 0° and 360°, $N_0$ is a given winding density, the sign of N (ϕ) denotes the winding direction, and C is a constant, wherein said ring-shaped element (21') comprises two parts (60,68), a first part (60) being positioned closer to the in-line electron gun (5) than a second part (68), at least one of said parts having the coils (22').

8. A deflection unit (51) comprising deflection coils (13') and convergence means (14') for dynamically influencing the convergence of electron beams (6,7,8), to decrease a distance (p) between the electron beams at a location of a deflection plane, the convergence means (14') comprising a ring-shaped element (21') having coils (22'), said coils (22') comprising electrically conductive wires which have been toroidally wound in a winding direction and according to a winding density distribution N (ϕ) given by N (ϕ)=$N_0$ cos (2ϕ)+C;

where ϕ is an angle enclosed by the X-direction and a line between an element of the coil and the center of the coil, which ranges between 0° and 360°, $N_0$ is a given winding density, the sign of N (ϕ) denotes the winding direction, and C is a constant unequal to zero.

9. A deflection unit according to claim 8, wherein said electron beams are generated by an in-line electron gun, and wherein said ring-shaped element (21') comprises two parts (60,68), a first part (60) being positioned closer to the in-line gun (5) than a second part (68), and at least one of said parts having the coils (22').

10. A method of manufacturing a convergence unit (14') for dynamically influencing a convergence of electron beams in a color display device (1), the convergence unit (14') comprising a ring-shaped element (21') having coils (22'), said method comprising the steps of:

providing the ring-shaped element (21'), winding an electrically conductive wire toroidally around the ring-shaped element (21') in a winding direction and according to a winding density distribution N (ϕ) given by N (ϕ)=$N_0$ cos (2ϕ)+C; where ϕ is an angle enclosed by the X-direction and a line between an element of the coil and the center, which ranges between 0° and 360°, $N_0$ is a given winding density,.the sign of N (ϕ) denotes the winding direction, and C is a constant unequal to zero.

11. A method of manufacturing a convergence unit according to claim 10, wherein each coil (22') has layers and the winding step comprises a first step of winding a first layer of each of the coils (22), and at least one further step of winding a further layer of each of the coils (22').

* * * * *